US007215225B2

(12) United States Patent
Fuke et al.

(10) Patent No.: US 7,215,225 B2
(45) Date of Patent: May 8, 2007

(54) SUPERCONDUCTOR FILTER

(75) Inventors: Hiroyuki Fuke, Kawasaki (JP); Yoshiaki Terashima, Yokosuka (JP); Fumihiko Aiga, Yokohama (JP); Mutsuki Yamazaki, Yokohama (JP); Hiroyuki Kayano, Fujisawa (JP); Tatsunori Hashimoto, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 22 days.

(21) Appl. No.: 10/849,472

(22) Filed: May 20, 2004

(65) Prior Publication Data

US 2005/0007210 A1 Jan. 13, 2005

(30) Foreign Application Priority Data

May 21, 2003 (JP) ..... 2003-143868

(51) Int. Cl.
*H01P 3/20* (2006.01)
*H01P 1/20* (2006.01)

(52) U.S. Cl. ..... 333/204; 333/212

(58) Field of Classification Search ..... 333/202, 333/204, 206, 212

See application file for complete search history.

(56) References Cited

U.S. PATENT DOCUMENTS 3,153,209 A * 10/1964 Kaiser ..... 333/204
3,754,198 A * 8/1973 Anghel ..... 333/204
4,264,881 A * 4/1981 De Ronde ..... 333/110
4,423,396 A * 12/1983 Makimoto et al. ..... 333/204
4,890,079 A * 12/1989 Sasaki ..... 333/206
4,992,759 A * 2/1991 Giraudeau et al. ..... 333/204
5,537,082 A * 7/1996 Tada et al. ..... 333/202
5,801,605 A * 9/1998 Filakovsky ..... 333/203
5,896,073 A * 4/1999 Miyazaki et al. ..... 333/204
6,130,591 A * 10/2000 Tsuzuki ..... 333/204
6,359,529 B1 * 3/2002 Tsunoda et al. ..... 333/101
6,624,728 B2 * 9/2003 Miyazaki et al. ..... 333/204
6,903,632 B2 * 6/2005 Hashimoto et al. ..... 333/204

FOREIGN PATENT DOCUMENTS

JP 9-186502 7/1997
JP 10-135706 5/1998

(Continued)

OTHER PUBLICATIONS

Hong, J. et al., "On the Development of Superconducting Microstrip Filters for Mobile Communications Applications", IEEE Transactions on Microwave Theory and Techniques, vol. 47, No. 9, pp. 1656-1663, (1999).

(Continued)

*Primary Examiner*—Robert Pascal
*Assistant Examiner*—Kimberly E Glenn
(74) *Attorney, Agent, or Firm*—Finnegan, Henderson, Farabow, Garrett & Dunner, L.L.P.

(57) ABSTRACT

A superconductor filter comprises a plurality of resonance elements arranged between input-output lines formed on a substrate. Metal conductor sections serving to inhibit the spatial coupling between the adjacent resonance elements are arranged between prescribed resonance elements, and a prescribed resonance element is coupled with another resonance element by a coupling transmission line. It follows that each resonance element is coupled with another resonance element by the direct coupling via the coupling transmission line or by the spatial coupling via the space.

8 Claims, 6 Drawing Sheets

FOREIGN PATENT DOCUMENTS

| | | |
|---|---|---|
| JP | 2001-102809 | 4/2001 |
| JP | 2003-124707 | 4/2003 |

OTHER PUBLICATIONS

Raihn, K.F. et al., "Highly Selective HTS Band Pass Filter With Multiple Resonator Cross-Couplings", IEEE Microwave Theory and Techniques Symposium Digest, pp. 661-664, (2000).

U.S. Appl. No. 10/838,249, filed May 5, 2004, to Aiga et al.

Notification of Reasons for Rejection issued by the Japanese Patent Office, mailed Jan. 9, 2007, in Japanese Application No. 2003-143868 and English translation of Notification.

* cited by examiner

SUPERCONDUCTOR FILTER

CROSS-REFERENCE TO RELATED APPLICATIONS

This application is based upon and claims the benefit of priority from the prior Japanese Patent Application No. 2003-143868, filed May 21, 2003, the entire contents of which are incorporated herein by reference.

BACKGROUND OF THE INVENTION

1. Field of the Invention

The present invention relates to a superconductor filter, particularly, to an improvement in the coupling of a resonance element included in a superconductor high frequency filter.

2. Description of the Related Art

A high frequency filter is incorporated as a main part in communication equipment for wireless communication or communication through wire of information. The high frequency filter, which performs the function of filtering a desired frequency band alone, is a functionally important constituent of the communication equipment. In order to operate the communication equipment in a more energy-efficient fashion by effectively utilizing the frequency, the high frequency filter is required to be good in the attenuation characteristics and to be small in the insertion loss. In order to prepare a filter meeting these requirements, it is necessary to obtain a resonance element having a high Q value. As a method for realizing a resonance element having a high Q value, it is proposed in recent years to use a high temperature superconductor material, which is a material having a very small surface resistance, as a conductor constituting the resonance element.

In the structure of a high frequency filter formed of a superconductor thin film, a half-wave resonance element or the like is formed by a distributed constant circuit such as a micro strip line on a substrate. In general, these resonance elements are arranged to form a multi-stage structure and are spatially connected to each other.

In a high frequency filter, the resonance elements are spatially coupled to each other by electromagnetism so as to determine the filter characteristics. Therefore, generally, varying the relative positions, at which the resonance elements are arranged, is used as the standard method of design. In other words, the filter is designed such that the adjacent resonance elements are arranged closely in the case where a strong coupling is required or further apart in the case where a weak coupling is required.

The Chebyshev function type filter, which is known as a typical filter structure, is constructed by utilizing the electromagnetic coupling alone between the adjacent resonance elements. In the Chebyshev function type filter, the resonance elements are linearly arranged such that a relatively large distance is provided between a certain resonance element and another resonance element other than the resonance element positioned adjacent to said certain resonance element, so as to make it relatively difficult for an undesired coupling to take place.

On the other hand, a pseudo elliptical function type filter is disclosed on page 1656 of "IEEE Transactions on Microwave Theory and Techniques, Vol. 47 (1999)". The pseudo elliptical function type filter is constructed such that a certain resonance element, i.e., a first resonance element, is intentionally coupled with a resonance element other than the resonance element positioned adjacent to the first resonance element, which is called a jumping coupling, for planarizing the group delay characteristics. Also disclosed on page 1656 of "IEEE Transactions on Microwave Theory and Techniques, Vol. 47 (1999)" is a method for achieving the adjacent coupling and the jumping coupling by utilizing the spatial coupling.

On the other hand, disclosed on page 661 of "IEEE Microwave Theory and Techniques Symposium Digest (2000)" is a method in which the spatial coupling is employed for the coupling of the adjacent resonance elements and a coupling transmission line, i.e., a transmission line for the coupling, is employed for the jumping coupling. In the prior art disclosed in this literature, the resonance elements are linearly arranged, and the resonance elements are arranged relatively far away from each other, except for the adjacent resonance elements.

As described above, the Chebyshev function type filter is constructed such that a relatively large distance is provided between the resonance elements other than the adjacent resonance elements so as to make it relatively difficult for an undesired coupling to take place. However, there is a lower limit in the distance between the resonance elements. It is impossible for the distance between the resonance elements to be zero, except for the distance between the adjacent resonance elements. It should be noted that the coupling between the resonance elements other than the coupling between the adjacent resonance elements gives rise to the problem that the actual filter characteristics deviate from the desired filter characteristics. To be more specific, it is necessary to redesign or adjust the arrangement of the resonance elements in an attempt to obtain the desired characteristics.

In the method of forming the adjacent coupling and the jumping coupling by using the spatial coupling, which is disclosed on page 1656 of "IEEE Transactions on Microwave Theory and Techniques, Vol. 47 (1999)" referred to above, the resonance elements that are originally irrelevant to each other in respect of the coupling are positioned close to each other in the process of forming a jumping coupling. As a result, a serious problem is generated that an undesired coupling is generated between the resonance elements positioned close to each other.

In the method disclosed on page 661 of "IEEE Microwave Theory and Techniques Symposium Digest (2000)" referred to above, a spatial coupling is employed for the coupling of the adjacent resonance elements, and the coupling transmission line is employed for the jumping coupling. In this method, a relatively large distance is provided between a certain resonance element and another resonance element other than the resonance element positioned adjacent to the said certain resonance element so as to make it relatively difficult for an undesired coupling to take place. However, there is a lower limit in the distance between the resonance elements. It is impossible for the distance between the resonance elements to be zero except the distance between the adjacent resonance elements. It should be noted in this connection that the filter of this construction gives rise to the problem that the actual filter characteristics deviate from the desired filter characteristics. To be more specific, it is necessary to redesign or adjust the arrangement of the resonance elements in an attempt to obtain the desired proper characteristics.

BRIEF SUMMARY OF THE INVENTION

According to an aspect of the present invention, there is provided a superconductor filter, comprising:

a substrate;

input and output lines formed on the substrate;

resonance elements arranged between the input and output lines;

transmission lines, formed on the substrate, at least one of the resonance elements being spatially coupled and directly coupled through one or two of the transmission lines to another ones of the resonance elements; and a metal conductor section formed on the substrate and arranged between the adjacent resonance elements which are directly connected by the transmission line, configured to prevent the adjacent resonance elements connected to the transmission line, from being substantially spatially coupled each other.

According to an another aspect of the present invention, there is also provided a superconductor filter, comprising:

a substrate;

input and output lines formed on the substrate;

first and second resonance elements arranged between the input and output lines, the first resonance elements adjacent to the input and output lines being spatially connected to the input-output lines, respectively, the second resonance elements being so arranged to be close to at least one of the second resonance elements;

first and second transmission lines, formed on the substrate, the first transmission line directly connecting the first resonance elements which are spatially connected to the adjacent ones of the second resonance elements, respectively, the second transmission line directly connecting adjacent two of the second resonance elements;

a metal conductor section formed on the substrate and arranged between the adjacent two of the second resonance elements which are directly connected by the second transmission line, configured to prevent the adjacent two of the resonance elements from being substantially spatially coupled each other.

According to an yet another aspect of the present invention, there is also provided a superconductor filter, comprising:

a substrate;

input and output lines formed on the substrate;

resonance elements arranged between the input-output lines, any one of the resonance elements being coupled another one or ones of the resonance elements;

a transmission line, formed on the substrate, configured to directly coupling one of the resonance elements with another one of the resonance elements; and a metal conductor section formed on the substrate, configured to prevent a pair of the adjacent resonance elements directly coupled by the transmission line from being spatially coupled each other, and permit one of the adjacent resonance elements to be spatially coupled to two or less of the other resonance elements.

DETAILED DESCRIPTION OF THE INVENTION

Superconductor filters according to some embodiments of the present invention will now be described with reference to the accompanying drawings.

Figure 1:
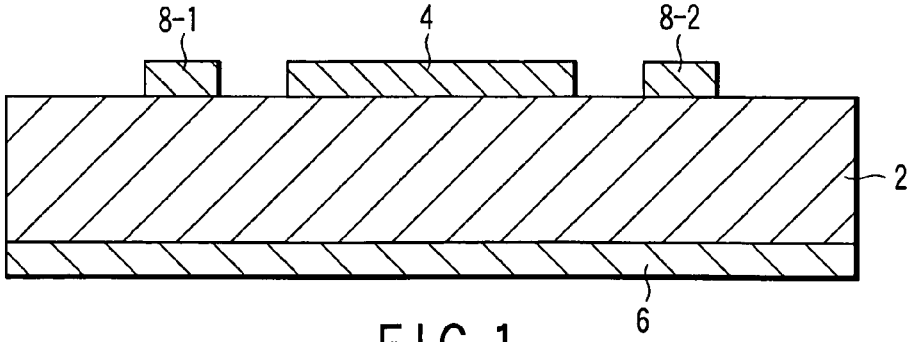
FIG. 1 is a cross sectional view schematically showing the basic construction of a superconductor filter according to one embodiment of the present invention.

FIG. 1 is a cross sectional view schematically showing the basic construction of a superconductor filter according to an embodiment of the present invention.

The resonator shown in FIG. 1 is a superconductor type of micro strip line resonator. As shown in the drawing, the resonator comprises a substrate 2. A pattern 4 of the resonator is formed on the upper surface of the substrate 2, and exciting lines 8-1 and 8-2 are formed on both sides of the pattern 4 of the resonator. Further, a thin film 6, e.g., a YBCO thin film formed of a Y-series copper oxide superconductor, is formed on the lower surface of the substrate 2. The substrate. 2 is formed of, for example, an MgO disk having a diameter of about 50 mm, a thickness of 0.43 mm, and a relative dielectric constant of about 10. The pattern 4 of the resonator is arranged in a region between the exciting lines 8-1 and 8-2. Each pattern 4 of the resonator and the exciting lines 8-1 and 8-2 is formed of a thin film, e.g., a YBCO thin film formed of a Y-series copper oxide superconductor. The thin film 6 formed on the lower surface of the substrate 2 is electrically connected to the ground.

A resonator in which the strip line in the micro strip line structure is formed in a prescribed shape is used as an example in the following description. However, it is possible for the resonator to be of any type as long as the planar transmission line structure is employed therein, and it is possible to apply the structure described in the following to the resonator. For example, it is possible to employ the pattern structure of the resonator described in the following even in the strip line in, for example, the strip structure and the coplanar structure.

Figure 2:
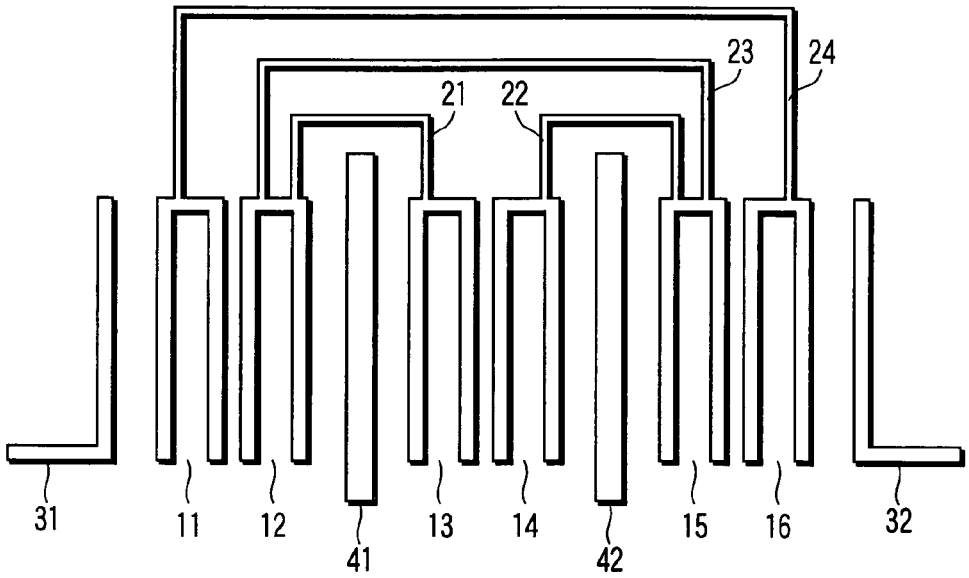
FIG. 2 is a plan view schematically showing the arrangement and the coupled state of resonance elements and the partition walls included in the superconductor filter according to one embodiment of the present invention.

FIG. 2 exemplifies the basic circuit pattern of the superconductor filter shown in FIG. 1. The circuit pattern shown in FIG. 2 comprises input-output lines 31, 32 formed on the substrate 2, resonance elements 11 to 16, coupling transmission lines 21, 22, 23, 24, and partition walls 41, 42. Each of the input-output lines 31, 32, the resonance elements 11 to 16, and the coupling transmission lines 21, 22, 23, 24 is formed as a thin film. On the other hand, each of the partition walls 41 and 42 is formed to have a sufficient thickness of a reasonable height, compared with each of the input-output lines 31, 32, the resonance elements 11 to 16, and the coupling transmission lines 21, 22, 23, 24 so as to perform the function of a partition wall. In general, the height of the partition wall is 10 to 20 times the thickness of the ordinary substrate. It should be noted that the partition wall is omitted in FIG. 1 for simplification of the drawing.

Each of the sections forming the circuit pattern, except the partition wall, is formed on the substrate 2 in a manner to have a certain thickness. However, since the thickness noted above is sufficiently small compared with the thickness of the substrate 2, the circuit pattern can be regarded as being formed substantially on a plane within a substantially planar space.

In the circuit pattern shown in FIG. 2, the input-output lines 31 and 32 are formed to face each other on the substrate 2, and first to sixth resonance elements (i.e., so-called hair pin type half-wave resonance elements) 11 to 16, each being shaped like U having angular corners, are arranged substantially parallel to each other such that the open portions of the resonance elements are positioned on the same side. Each of these resonance elements 11 to 16 has a resonance frequency of, for example, 1.93 GHz, a line width of, for example, 0.4 mm, and an entire length of about 30 mm. Each of the resonance elements 11 to 16 has two straight portions, which are arranged in substantially parallel each other and connecting portion which connects the straight portions so as to form the U-shaped form or hair pin shape. The entire length of the two straight portions and the connecting portion is defined so as to have a half of the resonance wavelength.

Each of the resonance elements 11 to 16 is coupled with predetermined one or ones of the other resonance elements. In other words, each of the coupling resonance elements 11 to 16 have a coupling relation to be coupled with predetermined one or ones of the resonance elements 11 to 16. Also, the coupling resonance elements 11 to 16 are classified into direct coupling resonance elements 11 to 16, which are directly coupled with each other, and spatial coupling resonance elements 11 to 16, which are spatially coupled with each other. Also, some of the resonance elements 11 to 16 have an uncoupling relation, in which spatial coupling with other resonance elements is inhibited, even if these resonance elements are positioned adjacent to each other.

To be more specific, the partition wall 41 made of a metal conductor is formed between the second resonance element 12 and third resonance element 13, which are positioned adjacent to each other, as shown in FIG. 2. Likewise, the partition wall 42 made of a metal conductor is formed between the fourth resonance element 14 and the fifth resonance element 15, which are positioned adjacent to each other. These partition walls 41 and 42 are intended to inhibit the spatial coupling between the adjacent resonance elements, i.e., between the second and third resonance elements 12 and 13 and between the fourth and fifth resonance elements 14 and 15. In order to inhibit the spatial coupling between the resonance elements 12 and 13 and between the resonance elements 14 and 15, each of the partition walls 41, 42 is formed longer than each of the resonance elements 12, 13, 14, 15 so as to prevent the resonance elements 12 and 13 from directly facing each other within a plane on the substrate 2 and to prevent the resonance elements 14 and 15 from directly facing each other within a plane on the substrate 2. As described above, the resonance elements 12, 13, 14, 15 are not allowed to face each other within a plane. This implies that the planar space on the substrate 2, which has a thickness substantially equal to the thickness of the resonance element and, thus, which is sufficiently small compared with the size of the element, is separated by intermediate members, i.e., the partition walls 41, 42 each formed of a metal conductor, and the resonance elements 12, 13, 14, 15 are arranged within the separated planar space. These resonance elements 11 to 16 are classified into three groups separated from each other by the partition walls 41 and 42. To be more specific, these resonance elements are classified into a first group consisting of the first and second resonance elements 11 and 12, which are spatially coupled with each other, a second group consisting of the third and fourth resonance elements 13 and 14, which are spatially coupled with each other, and a third group consisting of the fifth and sixth resonance elements 15 and 16, which are spatially coupled with each other.

In order to make the spatial field coupling negligibly small without using the partition wall formed of a metal conductor, it is necessary for the adjacent resonance elements to be arranged apart from each other by the distance that is at least 50 times the line width of the resonance element. It has been experimentally confirmed that a substantial field coupling is not generated between a certain interest resonance element and another resonance element positioned apart from the interest resonance element by the distance that is at least 50 times the line width of the resonance element. It follows that the resonance elements whose spatial field coupling with interest resonance element should be inhibited, except the resonance element that is to be spatially coupled by the field coupling with interest resonance element, are limited to those positioned within a distance from interest resonance element, which is not larger than 50 times the line width W of the resonance element (L=50W). Such being the situation, it is necessary to arrange the partition wall formed of a metal conductor in a manner to inhibit the spatial field coupling between interest resonance element and the resonance elements positioned apart from the interest resonance element by the distance not larger than the distance noted above (L=50W).

The second resonance element 12 and the third resonance element 13, whose spatial coupling is inhibited, are connected to each other by the coupling transmission line 21. Likewise, the fourth resonance element 14 and the fifth resonance element 13, whose spatial coupling is inhibited, are connected to each other by the coupling transmission line 22. Further, the second resonance element 12 and the fifth resonance element 15, whose spatial coupling is inhibited, are connected to each other by the coupling transmission line 23. Still further, the first resonance element 11 and the sixth resonance element 16, whose spatial coupling is inhibited, are connected to each other by the coupling transmission line 24. The connection noted above is not limited to the connection by the transmission line. It is possible to employ any construction as long as an electromagnetic field coupling is generated between the two resonance elements connected to each other. Also, it is not absolutely necessary for the coupling transmission line to be contiguous to the resonance element, and it is possible for a coupling element to be interposed between the coupling transmission line and the resonance element. The lines 31 and 32, which are the input-output lines, are connected to the outer element or line.

In the circuit pattern shown in FIG. 2, the hair pin type half-wave resonance elements 11 to 16 are linearly arranged. However, it is not absolutely necessary for these resonance elements 11 to 16 to be linearly arranged. Also, it is unnecessary for the open portions of the resonance elements 11 to 16 to be aligned on one side.

Figure 3:
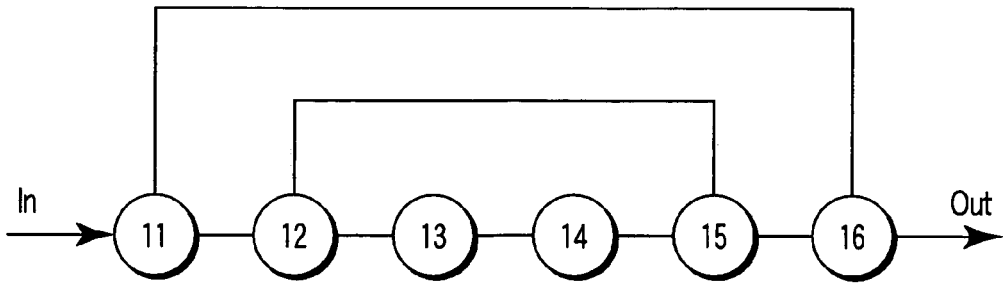
FIG. 3 shows connecting lines conceptually illustrating the coupling between different resonance elements required for obtaining desired characteristics in the superconductor filter shown in FIG. 2.

FIG. 3 conceptually shows the coupling of the resonance elements required for allowing the superconductor filter to exhibit desired characteristics. As shown in the drawing, each of the resonance elements 11, 12, 15 and 16 forms a jumping coupling in addition to the spatial coupling accompanying the adjacent arrangement. Also, the resonance element 12 is coupled with the resonance elements 11, 13 and 15. Further, the resonance element 15 is coupled with the resonance elements 12, 14 and 16.

In the circuit pattern shown in FIG. 2, the resonance elements 11 and 12 are coupled with each other by the spatial field coupling, the resonance elements 13 and 14 are coupled with each other by the spatial field coupling, and the resonance elements 15 and 16 are coupled with each other by the spatial field coupling. On the other hand, the resonance elements 12 and 13 are coupled with each other by the coupling transmission line 21, the resonance elements 14 and 15 are coupled with each other by the coupling transmission line 22, the resonance elements 12 and 15 are coupled with each other by the coupling transmission line 23, and the resonance elements 11 and 16 are coupled with each other by the coupling transmission line 24. It should be noted that the coupling transmission line 21 permits generating the coupling between the two resonance elements to which the transmission line 21 is connected. Also, the transmission line 22 permits generating the coupling between the two resonance elements to which the transmission line 22 is connected. Further, the transmission line 23 permits generating the coupling between the two resonance elements to which the transmission line 23 is connected. It should also be noted that the transmission lines 21, 22 and 23 do not generate the coupling between the resonance elements to which these transmission lines are not connected. Also, the resonance elements are separated by the partition walls into three groups each consisting of two resonance elements. It follows that each resonance element is spatially positioned to directly face a single resonance element within the same group of the resonance elements. In other words, the spatial field coupling is not generated between the resonance elements other than the paired resonance elements forming the same group such that the spatial field coupling is generated only between the resonance elements 11 and 12, between the resonance elements 13 and 14, and between the resonance elements 15 and 16.

Further, the resonance element 12 is connected to the resonance elements 13 and 15 by the coupling transmission lines 21 and 23, respectively. Where two resonance elements are coupled with each other by the coupling transmission line, the intensity of the coupling is determined mainly by the site at which the transmission line is connected to the resonance element. Where the edges of the transmission line are connected to the central portion of each of the resonance elements, the coupling amount is rendered zero, and the coupling amount is increased in accordance with the deviation of the connecting point toward the edge portion of the resonance element. In other words, the site at which a prescribed value of the coupling amount can be obtained has a prescribed distance away from the center point of the resonance element. There are two particular sites on both sides of the center of the resonance element. The connecting position of the coupling transmission line required for obtaining a desired coupling between the resonance element 12 and the resonance element 13, i.e., the distance between the center point CP of the entire length of the resonance element 12 and the connecting point, is substantially equal to the connecting point of the coupling transmission line required for obtaining a desired coupling between the resonance element 12 and the resonance element 15. However, it is possible to arrange the coupling transmission lines while avoiding the overlapping arrangement by allowing the connecting points to be positioned on the left side and the right side of the center point CP of the resonance element. It is also possible to similarly arrange the coupling transmission lines in respect of the resonance element 15. It follows that it is possible to arrange the coupling transmission lines 22 and 23 in a manner to prevent these coupling transmission lines 22 and 23 from being intersected each other and to prevent the connecting points from being overlapped with each other.

As described above, in the case of employing the coupling using the coupling transmission line, at most two coupling transmission lines can be connected to a single resonance element even if the intensity of the coupling is substantially the same and, thus, two or less, including zero, coupling transmission lines 22, 23 can be connected to a single resonance element in accordance with the construction of the circuit pattern.

As described above, in the superconductor filter having a circuit pattern as shown in FIG. 2, it is possible to realize in an ideal manner a desired coupling as shown in FIG. 3. The superconductor filter was cooled to 70K so as to measure the microwave characteristics. The central frequency was found to be 1.93 GHz, the passing bandwidth was found to be 20 MHz, the ripple was found to be 0.1 dB or less, and the insertion loss was found to be 0.1 dB or less, supporting that it was possible to obtain desired filter characteristics.

Incidentally, FIGS. 1 and 2 show a filter of a micro strip line structure. However, the technical idea of the present invention can be applied to a filter of any construction as long as the filter has a planar transmission line structure. Also, as already described, the technical idea of the present invention can also be applied to, for example, a strip line structure or a coplanar structure.

Also, a half-wave resonance element is exemplified as the resonance element. However, it is apparent that the resonance element used in the present invention is not limited to the half-wave resonance element.

Still further, the substrate is not limited to an MgO substrate. It is also possible to use, for example, an $LaAlO_3$ substrate or a sapphire substrate. It is also possible to form a buffer layer between the substrate and the superconductor film in order to obtain a high quality Y-series copper oxide superconductor film. It is possible for the buffer layer to be formed of, for example, $CeO_2$ or YSZ.

It is further possible to employ, for example, a sputtering method, a laser vapor deposition method or a CVD method for forming the Y-series copper oxide superconductor film. An appropriate thickness of the superconductor film is about 500 nm. It is possible to obtain a superconductor filter by processing one surface of the superconductor film by the lithography method. Also, it is possible for the back surface formed of a superconductor film to be electrically connected to the ground. The superconductor filter is fixed to a copper base plated with gold so as to be connected to the input-output line. In order to improve the electrical contact, it is possible to form a gold thin film in the portion where the superconductor filter is connected to the ground potential point or the input-output line.

Examples of the present invention directed to various circuit patterns will now be described.

EXAMPLE 1

Figure 4:
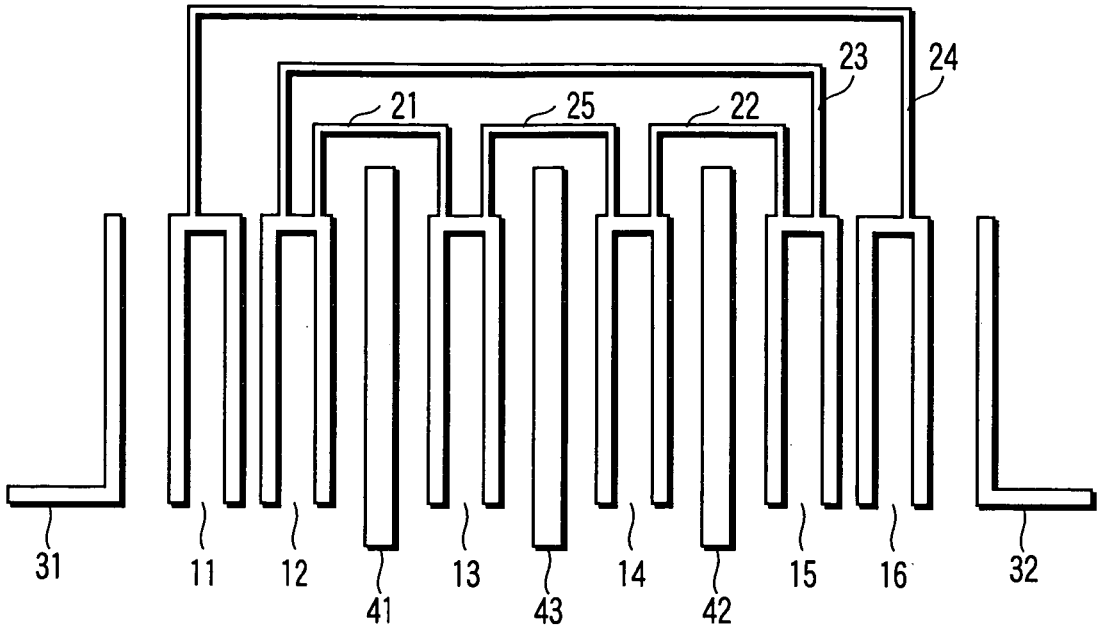
FIG. 4 is a plan view schematically showing the arrangement and the coupled state of the resonance elements and the partition walls included in the superconductor filter according to another embodiment of the present invention.

It is possible to employ the arrangement and the coupled state of the resonance elements and the partition walls shown in FIG. 4 as a pattern for realizing the coupling of the resonance elements shown in FIG. 3. In this Example, a partition wall 43 formed of a metal conductor is also formed between the resonance element 13 and the resonance element 14 so as to cause the resonance element 13 and the resonance element 14 to be isolated in respect of the spatial coupling and to be coupled by a coupling transmission line 25. As described previously, the partition wall 43 is formed longer than each of the resonance element 13 and the resonance element 14 so as to prevent these resonance elements 13 and 14 from directly facing each other on the substrate plane.

In Example 1, the number of resonance elements that are allowed to face a certain resonance element directly via the space is at most one, i.e., one or zero, and thus, an unnecessary spatial field coupling is not generated. Also, since the number of coupling transmission lines connected to a single resonance element is two or less, it is possible to avoid the problem that the connecting points of the coupling transmission lines are caused to overlap each other. It follows that the superconductor filter of the pattern shown in FIG. 4 makes it possible to realize the desired coupling shown in FIG. 3 in an ideal manner. The superconductor filter of the particular construction was cooled to 70K so as to measure the microwave characteristics. The central frequency was found to be 1.93 GHz, the passing bandwidth was found to be 20 MHz, the ripple was found to be 0.1 dB or less, and the insertion loss was found to be 0.1 dB or less, supporting that it was possible to obtain desired filter characteristics.

EXAMPLE 2

Figure 5:
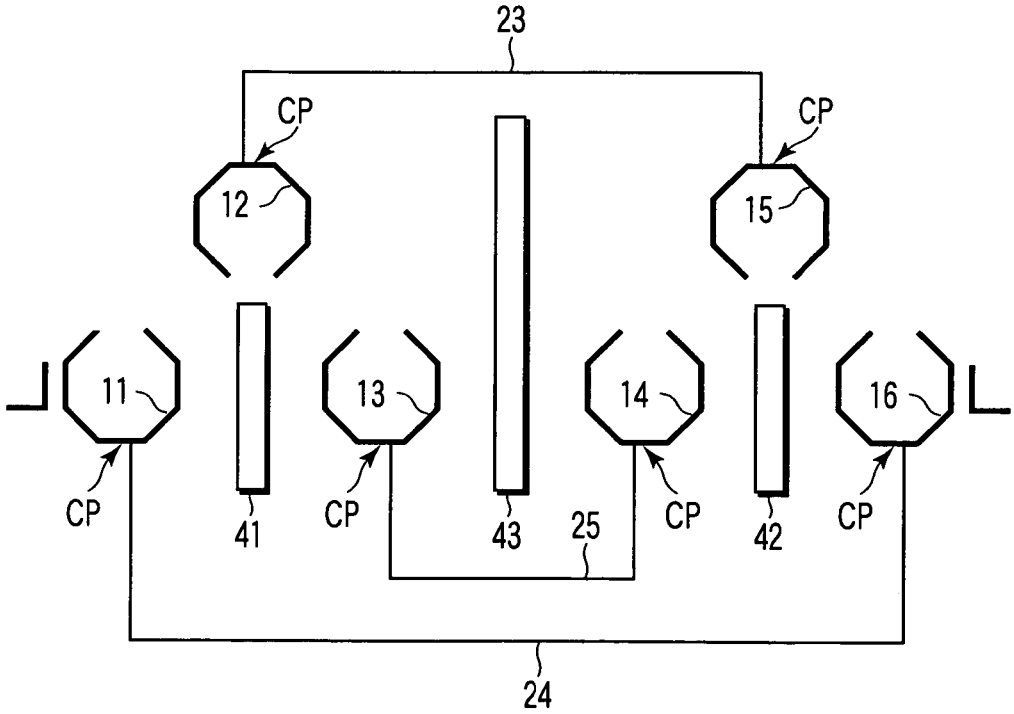
FIG. 5 shows connecting lines conceptually illustrating the coupling between different resonance elements required for obtaining desired characteristics in the superconductor filter shown in FIG. 4.

It is possible to employ the arrangement and the coupled state of the resonance elements and the partition walls shown in FIG. 5 as a pattern for realizing the coupling of the resonance elements shown in FIG. 3. In this Example, the second resonance element 12 is allowed to directly face the first resonance element 11 and the third resonance element 13, which are positioned adjacent to the second resonance element 12, on the substrate plane within a range of the distance from the second resonance element 12, which is not larger than the distance that is 50 times the line width so as to permit the second resonance element 12 to be coupled with each of the first resonance element 11 and the third resonance element 13 by the spatial field coupling. However, the partition wall 41 consisting of a metal conductor is formed between the first resonance element 11 and the third resonance element 13, which are positioned adjacent to each other, so as to prevent the first resonance element 11 and the third resonance element 13 from being spatially coupled with each other. This is also the case with the fourth resonance element 14, the fifth resonance element 15 and the sixth resonance element 16. To be more specific, the fifth resonance element 15 is allowed to directly face the fourth resonance element 14 and the sixth resonance element 16, which are positioned adjacent to the fifth resonance element 15, on the substrate plane within a range of the distance from the fifth resonance element 15, which is not larger than the distance that is 50 times the line width so as to permit the fifth resonance element 15 to be coupled with each of the fourth resonance element 14 and the sixth resonance element 16 by the spatial field coupling. However, the partition wall 42 consisting of a metal conductor is formed between the fourth resonance element 14 and the sixth resonance element 16, which are positioned adjacent to each other, so as to prevent the fourth resonance element 14 and the sixth resonance element 16 from being spatially coupled with each other.

Further, it is possible for a metal partition wall 43 to be formed between a first group of the resonance elements consisting of the first to third resonance elements 11, 12, 13 and a second group of the resonance elements consisting of the fourth to sixth resonance elements 14, 15, 16 so as to prevent the resonance elements in the first group from directly facing each other and forming a spatial coupling with the resonance elements in the second group.

The resonance element 11 and the resonance element 16 are coupled with each other by the coupling transmission line 24. Also, the resonance element 12 and the resonance element 15 are coupled with each other by the coupling transmission line 23. Further, resonance element 13 and the resonance element 14 are coupled with each other by the coupling transmission line 25. As shown in FIG. 5, the number of coupling transmission lines connected to each of the resonance elements 11 to 16 is two or less as in the Examples described previously, with the result that a problem is not generated in respect of the connecting positions. As described above, the superconductor filter of the pattern shown in FIG. 5 makes it possible to achieve a desired coupling as shown in FIG. 3 in an ideal manner so as to obtain desired filter characteristics.

Incidentally, the pattern shown in FIG. 5 includes a pattern in which the connecting sections at which the coupling transmission lines are connected to the resonance elements are in symmetry on the left and right sides, i.e., the coupling between the resonance element 13 and the resonance element 14, and a pattern in which the connecting sections noted above are in asymmetry on the left and right sides, i.e., the coupling between the resonance element 12 and the resonance element 15. In general, the coupling is classified into a capacitive coupling and a magnetic coupling. It is necessary to utilize either of these couplings as required. Where a coupling transmission line is used for achieving the coupling, it is possible to form the capacitive coupling or the magnetic coupling depending upon whether the connecting positions to the resonance element are in symmetry or in asymmetry on the left and right sides. In the pattern shown in FIG. 5, one coupling transmission line is connected to each of the resonance elements so as to make it possible to allow the connecting positions to the resonance element to be in symmetry or in asymmetry. It follows that the construction in which a single coupling transmission line is connected to the resonance element is useful in the case where it is necessary to form the capacitive coupling or the magnetic coupling.

EXAMPLE 3

Figure 6:
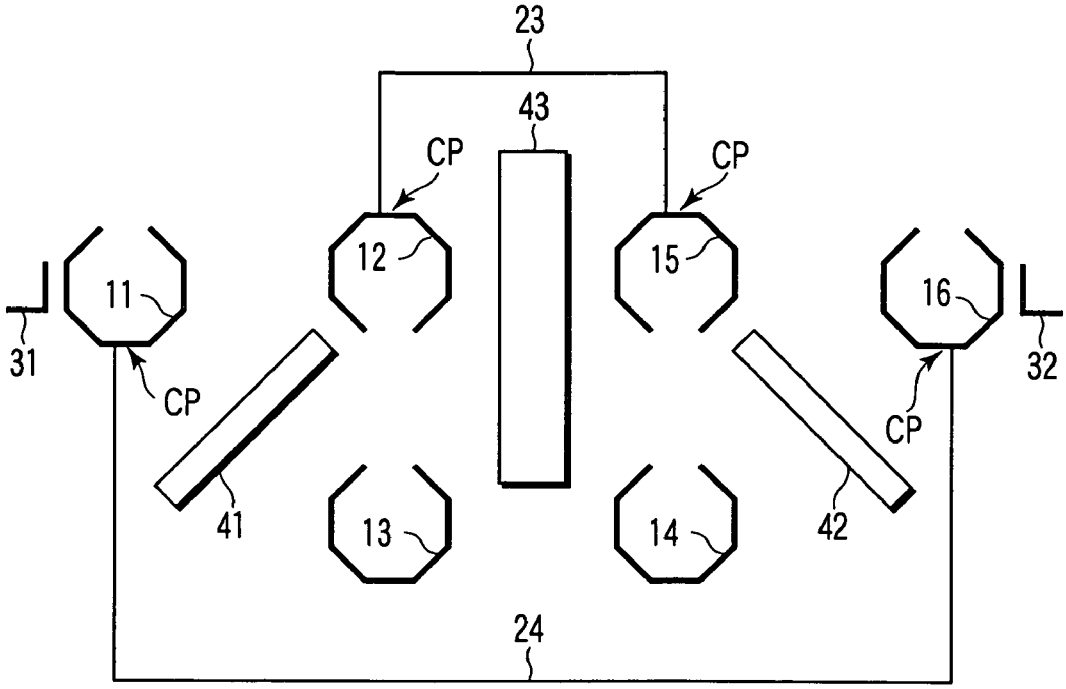
FIG. 6 is a plan view schematically showing the arrangement and the coupled state of the resonance elements and the partition walls included in the superconductor filter according to still another embodiment of the present invention.

It is possible to employ the arrangement and the coupled state of the resonance elements and the partition walls shown in FIG. 6 as a pattern for realizing the coupling of the resonance elements shown in FIG. 3. In this Example, the resonance elements 11 to 16 are arranged to form pairs of the adjacent resonance elements that are coupled with each other by the spatial field coupling within a range of the distance not larger than 50 times the line width. Two resonance elements are positioned to directly face each of the resonance element 12 and the resonance element 15 via the space within a plane on the substrate 2. However, since the partition walls 41, 42 are formed within a plane on the substrate, the adjacent resonance elements are separated from each other on the substrate so as to substantially inhibit the spatial field coupling. To be more specific, the resonance element 11 and the resonance element 13 are arranged adjacent to each other on the substrate 2, but are separated from each other by the partition wall 41 on the planar space on the substrate 2 so as to substantially inhibit the spatial field coupling between the resonance elements 11 and 13. Likewise, the resonance element 14 and the resonance element 16 are arranged adjacent to each other on the substrate 2, but are separated from each other by the partition wall 42 on the planar space on the substrate 2 so as to substantially inhibit the spatial field coupling between the resonance elements 14 and 16. It should also be noted that a first group of the resonance elements consisting of the resonance elements 11 to 13 and a second group of the resonance elements consisting of the resonance elements 14 to 16 are separated from each other by the partition wall 43 within a planar space on the substrate 2 so as to substantially inhibit the spatial field coupling between the resonance elements of the first group and the resonance elements of the second group. Incidentally, two resonance elements, i.e., the resonance element 12 and the resonance element 14, are positioned to directly face the resonance element 13 via the space within a plane on the substrate 2, and two resonance elements, i.e., the resonance element 13 and the resonance element 15, are positioned to directly face the resonance element 14 via the space within a plane on the substrate 2.

The resonance element 11 is coupled with the resonance element 16 by the jumping coupling via the coupling transmission line 24. Also, the resonance element 12 is coupled with the resonance element 15 by the jumping coupling via the coupling transmission line 23. Two or less coupling transmission lines are connected to any of these resonance elements, with the result that a problem is not generated in respect of the connecting positions of the resonance element. As described above, the superconductor filter of the pattern shown in FIG. 6 makes it possible to realize a desired coupling shown in FIG. 2 in an ideal manner so as to obtain desired filter characteristics.

In this Example, the number of coupling transmission lines used is small, i.e., only two coupling transmission lines are used. It is desirable for the length of the coupling transmission line to be ¼ or ¾ of the wavelength λ corresponding to the resonance frequency of the resonance element. The wavelength is increased with the decrease in the central frequency of the desired superconductor filter. To be more specific, if the central frequency is decreased to 1 GHz, the wavelength corresponding to the resonance frequency of the resonance element on the MgO substrate is increased to 100 mm or more. In this case, the length of the coupling transmission line is increased to 25 mm in the case of ¼ λ and to 75 mm in the case of ¾ λ. The superconductor filter is cooled to a low temperature for its operation and, thus, it is convenient for the element size to be compact. The compact size is also advantageous in view of the manufacturing cost. The patterns suitable for realizing the coupling of the resonance elements shown in FIG. 3 are exemplified in FIGS. 2 to 6. Particularly, the pattern in which the number of coupling transmission lines is small as in FIG. 6 permits the element size to be compact and, thus, is advantageous in view of the cooling efficiency and the manufacturing cost.

It should also be noted that the wavelength is increased with the decrease in the central frequency of the desired superconductor filter as described above and, thus, the length of the resonance element is also increased. If the resonance element is folded finely, the layout can be made compact, which is advantageous in view of the cooling efficiency and the manufacturing cost. In general, the coupling transmission line is connected to the resonance element at the position about several percent deviant in the distance from the central point of the entire length of the resonance element. It follows that, where the resonance element is finely folded, it is desirable to fold the resonance element such that the region within about several percent of the entire length from the central portion of the entire length of the resonance element is exposed to the outside in order to facilitate the connection of the coupling transmission line to the resonance element. In other words, it is desirable for the resonance element to be provided with an extended section having a length of about several percent of the entire length of the resonance element in the opposite directions from the central point of the entire length of the resonance element, and for the coupling transmission line to be connected to the extended section.

Figure 7:
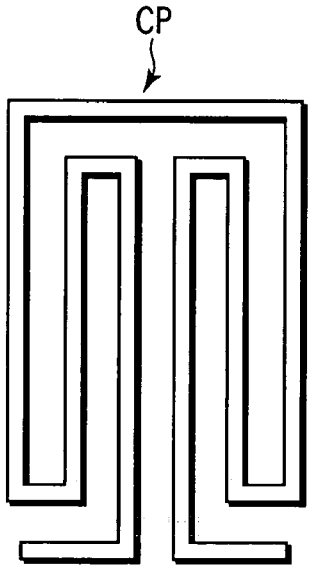
FIG. 7 is a plan view schematically exemplifying the construction of a resonance element included in a superconductor filter according to an embodiment of the present invention.
Figure 8:
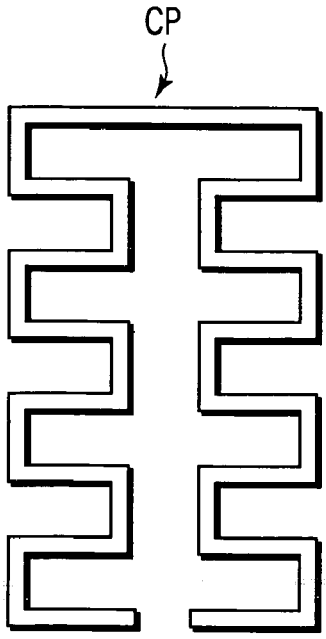
FIG. 8 is a plan view schematically showing the construction of a modification of the resonance element included in a superconductor filter according to an embodiment of the present invention.
Figure 9:
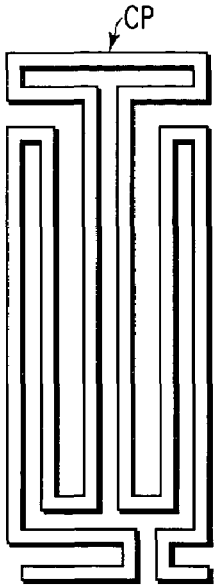
FIG. 9 is a plan view schematically showing the construction of another modification of the resonance element included in a superconductor filter according to an embodiment of the present invention.
Figure 10:
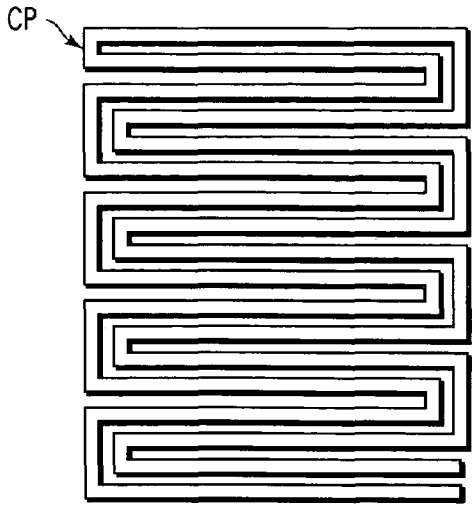
FIG. 10 is a plan view schematically showing the construction of still another modification of the resonance element included in a superconductor filter according to an embodiment of the present invention.

The shape of each of the resonance elements 11 to 16 is not limited to the U shape as shown in FIGS. 2 and 4 or to the polygonal shape having an open section as shown in FIGS. 5 and 6. In other words, it is possible for each of the resonance elements 11 to 16 to assume various shapes as shown in FIGS. 7 to 10. In FIG. 7, the line segment of the resonance element is folded so as to permit the resonance element to be shaped like a reversed T. In FIG. 8, the line segment of the resonance element is folded so as to permit the resonance element to be shaped like a ladder. In the resonance element shown in each of FIGS. 7 and 8, the left portion and the right portion are in symmetry with respect to the central line. It follows that the center point CP of the line segment length is positioned on the central line. On the other hand, in the resonance element shown in each of FIGS. 9 and 10, the left portion and the right portion of the resonance element are in asymmetry with respect to the central line. It follows that the center point CP in the line segment length of the resonance element is deviated from the central line. In the resonance element having a symmetrical configuration, it suffices for the extending section to which the coupling transmission line is connected such that two coupling transmission lines can be connected to the resonance element to be formed in a manner to extend from the center point to the left and the right by a distance of about several percent of the entire length and for the extending section to be arranged outward of the resonance element for connection of the extending section to the coupling transmission line. On the other hand, in the resonance element of the asymmetric configuration, it suffices for the extending section to which the coupling transmission line is connected in a manner to permit a single coupling transmission line to be connected to the extending section to extend leftward or rightward from the center point by the distance of about several percent of the entire length and for the extending section to be arranged outward of the resonance element for connection to the coupling transmission line.

Figure 11:
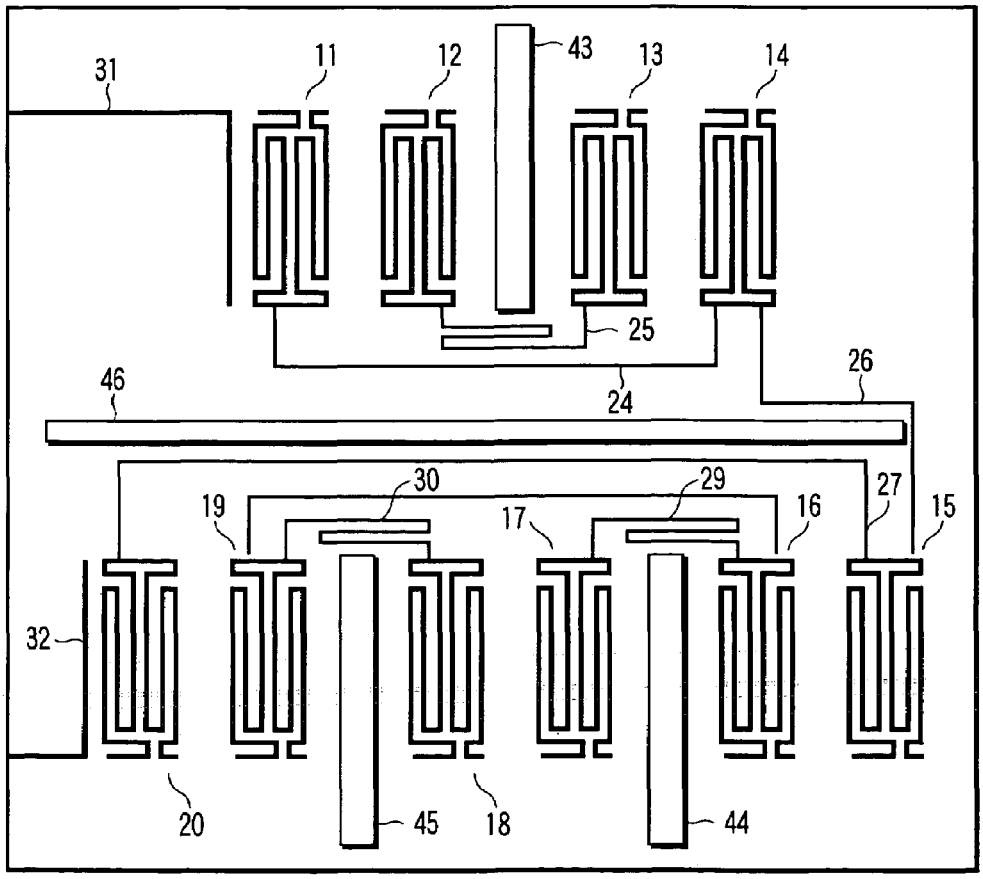
FIG. 11 is a plan view schematically showing the arrangement and the coupled state of the resonance elements and the partition walls included in the superconductor filter according to a further embodiment of the present invention.

Each of the Examples described above is directed to a superconductor filter including six resonance elements. Needless to say, however, it is possible for the superconductor filter to include seven or more resonance elements or five or less resonance elements. Of course, it is possible for the superconductor filter to include an even number of resonance elements or an odd number of resonance elements. FIG. 11 exemplifies a superconductor filter including the first to tenth resonance elements 11 to 20. In the superconductor filter shown in FIG. 11, the ten resonance elements 11 to 20 are classified into five groups each consisting of two resonance elements by metal partition walls 43 to 46. The resonance elements forming the same group are spatially coupled with each other. Also, the resonance elements forming a single group are coupled with resonance elements included in other groups by coupling transmission lines 24 to 28.

In the Examples described above, the resonance elements are coupled with each other in a manner to form a symmetrical configuration with respect to the vertical center line as apparent from the conceptual drawings shown in FIGS. 3, 5 and 6. However, it is not absolutely necessary for the resonance elements to be coupled with each other in a manner to form a symmetrical configuration. Also, the input-output sections are coupled with the resonance elements by a coupling system that is called a gap excitation in which the input-output sections positioned away from the resonance elements are coupled with the resonance elements. However, the coupling system is not limited to the system utilizing the gap excitation. It is also possible to employ, for example, a tap excitation, i.e., the excitation at the tap, in which the input-output sections are directly connected to the resonance elements.

EXAMPLE 4

Figure 12:
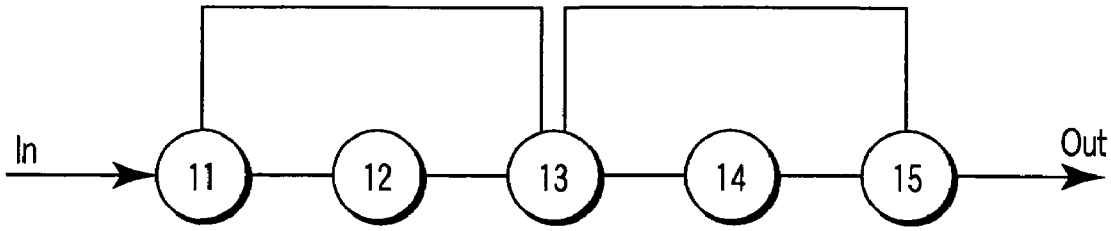
FIG. 12 shows the connecting lines conceptually showing the coupling between the resonance elements required for obtaining desired characteristics in a superconductor filter according to a modified embodiment of the present invention comprising a resonance element coupled with four other resonance elements.
Figure 13:
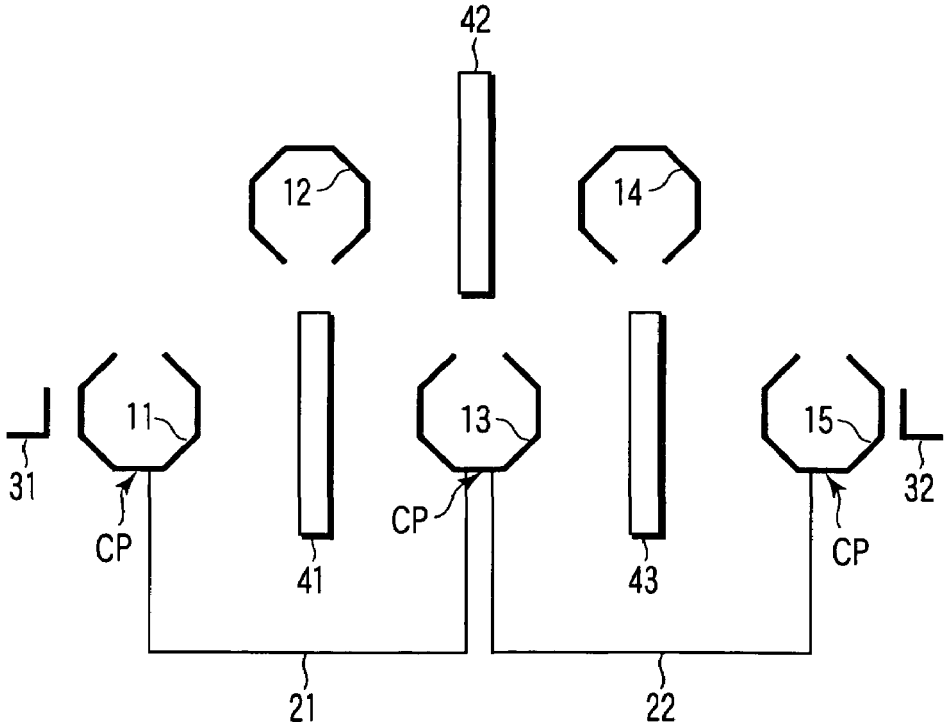
FIG. 13 is a plan view schematically exemplifying the arrangement and the coupled state of the resonance elements and the partition walls included in a superconductor filter that permits realizing the connecting lines shown in FIG. 12.

FIG. 13 exemplifies the arrangement of resonance elements as a pattern for realizing the coupling of the resonance elements including the resonance element 13 having four coupling ports as shown in FIG. 12. As shown in FIG. 13, the resonance element 13 is spatially coupled with the resonance element 12 and the resonance element 14 and is coupled by the coupling transmission lines 21 and 22 with the resonance element 11 and the resonance element 15, respectively. In the arrangement shown in FIG. 13, the spatial field coupling that is originally unnecessary is inhibited by the metal partition walls 41, 42 and 43, and two or less coupling transmission lines, i.e., the coupling transmission lines 21 and/or 22, are connected to a single resonance element 11, 12 or 15 so as not to bring about a problem in respect of the connection as in the Examples described previously. It follows that the superconductor filter of the pattern shown in FIG. 13 also makes it possible to achieve a desired coupling shown in FIG. 12 in an ideal manner so as to obtain desired filter characteristics.

Similarly, even where the pattern includes a resonance element having five or more coupling ports and even where two or less coupling transmission lines are connected to the resonance element and a plurality of resonance elements are positioned adjacent to a certain resonance element, the resonance elements can be arranged separately on a planar space on the substrate so as to make it possible to achieve a desired coupling in an ideal manner, thereby realizing desired filter characteristics.

EXAMPLE 5

Figure 14:
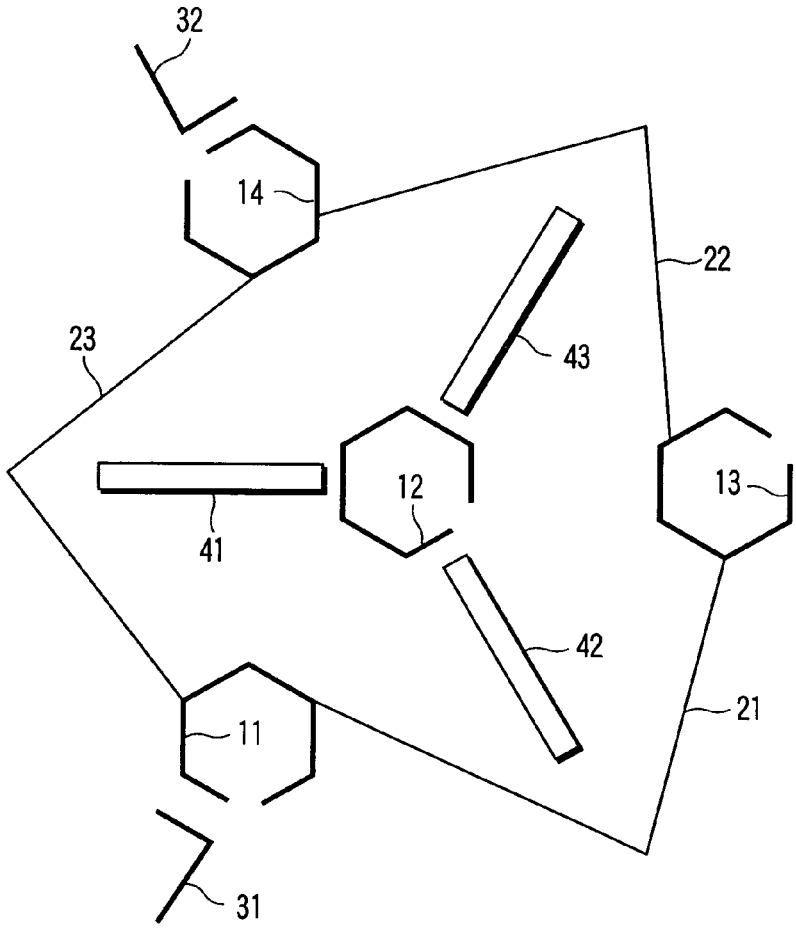
FIG. 14 is a plan view schematically exemplifying the arrangement and the coupled state of the resonance elements and the partition walls included in a superconductor filter according to another modified embodiment of the present invention comprising a resonance element spatially coupled with three other resonance elements by the electromagnetic coupling.
Figure 15:
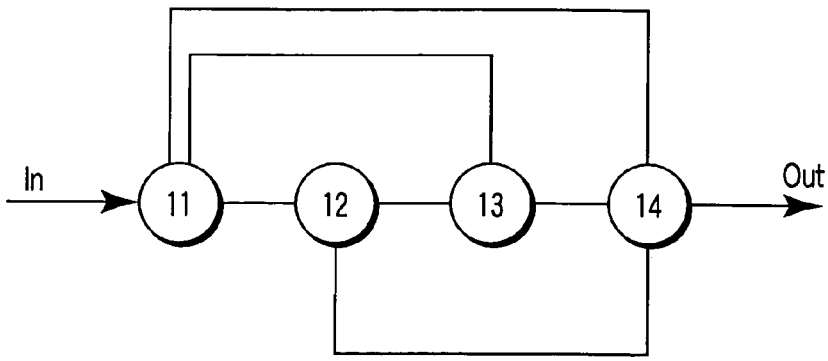
FIG. 15 shows connecting lines conceptually illustrating the coupling between the resonance elements required for obtaining desired characteristics in the superconductor filter shown in FIG. 14.

FIG. 14 exemplifies a pattern in which three resonance elements 11, 13, 14 are positioned adjacent to a certain resonance element 12 and these resonance elements are spatially coupled with each other. The pattern shown in FIG. 14 corresponds to the pattern for realizing the coupling conceptually shown in FIG. 15. As shown in FIG. 14, even where the three resonance elements 11, 13, 14 are arranged adjacent to the resonance element 12 so as to be spatially coupled with each other, the metal partition walls 41, 42, 43 prevent the resonance elements 11, 13, 14 other than the resonance element 12 from being spatially coupled with each other, thereby inhibiting an unnecessary spatial field coupling. Also, the resonance elements 11 and 13 are coupled with each other by the coupling transmission line 21, the resonance elements 13 and 14 are coupled with each other by the coupling transmission line 22, and the resonance elements 11 and 14 are coupled with each other by the coupling transmission line 23. Even in this circuit pattern, two or less coupling transmission lines are connected to each of the resonance elements so as to avoid the problem in respect of the connection. It follows that a desired coupling can be achieved in an ideal manner so as to realize desired filter characteristics.

Similarly, even where four or more resonance elements are spatially coupled with a certain resonance element, two or less coupling transmission lines are coupled with the resonance element. It follows that, even where a plurality of resonance elements are spatially coupled with a certain resonance element, it is possible to arrange the resonance elements such that these resonance elements cannot be spatially coupled with each other. Such being the situation, a desired coupling can be achieved in an ideal manner so as to realize desired filter characteristics.

As described above, a superconductor filter, comprises a substrate, input and output lines formed on the substrate, at laeast three resonance elements arranged between the input and output lines and coupled together by spatial coupling or by direct coupling at not more than two positions, a transmission line, formed on the substrate, for directly coupling the resonance elements of one pair, and a metal conductor section, formed on the substrate, for permitting arbitrary three ones of the resonance elements to be spatially coupled together at not more than two positions.

As described above, the present invention provides a superconductor filter capable of preventing an undesired coupling between resonance elements so as to make it possible to obtain a desired coupling. Also, in a superconductor filter according to another embodiment of the present invention, it is possible to set the connecting points of the coupling transmission line not to overlap with each other in the resonance element. In a superconductor filter of this type, it is possible to realize a desired coupling in an ideal manner so as to make it possible to obtain desired filter characteristics.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A superconductor filter, comprising:

a substrate;

input and output lines formed on the substrate;

first and second resonance elements formed of microstrip lines or strip lines and arranged between the input and output lines, wherein the first resonance elements are adjacent to the input and output lines and spatially connected to the input and output lines, respectively, and wherein one of the second resonance elements is so arranged to be close to at least another one of the second resonance elements forming a first pair of second resonance elements;

first and second transmission lines formed on the substrate, the first transmission line directly connecting the first resonance elements, and the second transmission line directly connecting the first pair of second resonance elements;

a first metal conductor section formed on the substrate and arranged between the first pair of second resonance elements, configured to prevent the first pair of second resonance elements from being substantially spatially coupled to each other.

2. The superconductor filter according to claim 1, wherein at least one of the second resonance elements is spatially coupled to two other second resonance elements, and is connected to no transmission line.

3. The superconductor filter according to claim 1, wherein at least one of the second resonance elements is so arranged to be surrounded by other second resonance elements, is spatially coupled to one of the second resonance elements, and is connected to no transmission line.

4. The superconductor filter according to claim 1, wherein the second resonance elements comprise a second pair of second resonance elements, the filter further comprising:

a second metal conductor section formed on the substrate and arranged between the second pair of second resonance elements which are directly connected to each other through a third transmission line, configured to prevent the second pair of second resonance elements from being substantially spatially coupled to each other.

5. The superconductor filter according to claim 1, wherein each of the first and second resonance elements includes a pair of straight parts and a connecting part connecting the straight parts.

6. The superconductor filter according to claim 5, wherein the straight parts and the connecting part of the first and second resonance elements form a polygonal shape.

7. The superconductor filter according to claim 5, wherein the second transmission lines extend from the connecting part.

8. The superconductor filter according to claim 1, wherein the substrate comprises a surface, and wherein the input and output lines, the first and second resonance elements, the first and second transmission lines, and the first metal conductor section are formed on the surface.

* * * * *